US007497939B2

(12) United States Patent
Matsumura et al.

(10) Patent No.: US 7,497,939 B2
(45) Date of Patent: Mar. 3, 2009

(54) METHOD FOR PRODUCING VEGETABLE OIL FUEL

(75) Inventors: Masatoshi Matsumura, 1250-2 Koya, Tsukuba City, Ibaraki (JP); Nestor Urian Soriano, Jr., Laguna (PH); Veronica P. Migo, Laguna (PH); Nakao Nomura, Chiryu (JP)

(73) Assignees: Foundation For Advancement of International Science, Ibaraki (JP); Masatoshi Matsumura, Ibaraki (JP)

( * ) Notice: Subject to any disclaimer, the term of this patent is extended or adjusted under 35 U.S.C. 154(b) by 346 days.

(21) Appl. No.: 10/679,852

(22) Filed: Oct. 6, 2003

(65) Prior Publication Data

US 2004/0108219 A1 Jun. 10, 2004

(51) Int. Cl.

| | |
|---|---|
| ***C10G 15/00*** | (2006.01) |
| ***C10G 27/14*** | (2006.01) |
| *C25B 3/04* | (2006.01) |

(52) U.S. Cl. ..... 205/695; 205/696

(58) Field of Classification Search ..... 44/307, 44/628, 639; 205/695, 696

See application file for complete search history.

(56) References Cited

U.S. PATENT DOCUMENTS

| | | | | |
|---|---|---|---|---|
| 6,218,556 | B1 * | 4/2001 | Pintauro | 554/124 |
| 6,364,917 | B1 * | 4/2002 | Matsumura et al. | 44/301 |
| 2003/0167681 | A1 * | 9/2003 | Delgado Puche | 44/388 |
| 2005/0160666 | A1 * | 7/2005 | Fujita | 44/605 |

* cited by examiner

*Primary Examiner*—Arun S Phasge
(74) *Attorney, Agent, or Firm*—Dykema Gossett PLLC

(57) ABSTRACT

A method for producing vegetable oil fuel with low viscosity, including a transesterification step $P_1$ with respect to vegetable oil with triglyceride structure having unsaturated fatty acid, an ozone treatment step $P_2$ with respect to unsaturated fatty acid methyl ester generated in the transesterification step $P_1$, and a reduction step $P_3$ with respect to the ozonide generated in the ozone treatment step $P_2$.

4 Claims, 11 Drawing Sheets

【Fig. 1】
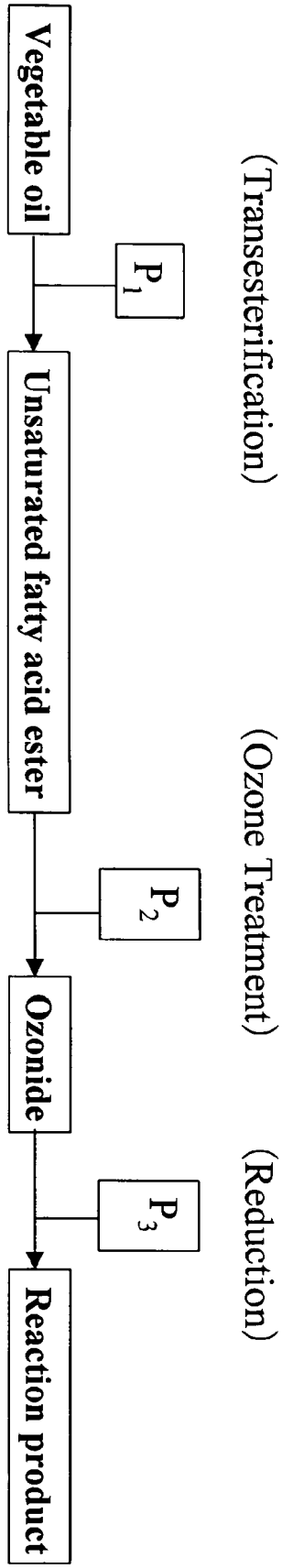

【Fig. 2】
(A)
Sunflower oil methyl ester
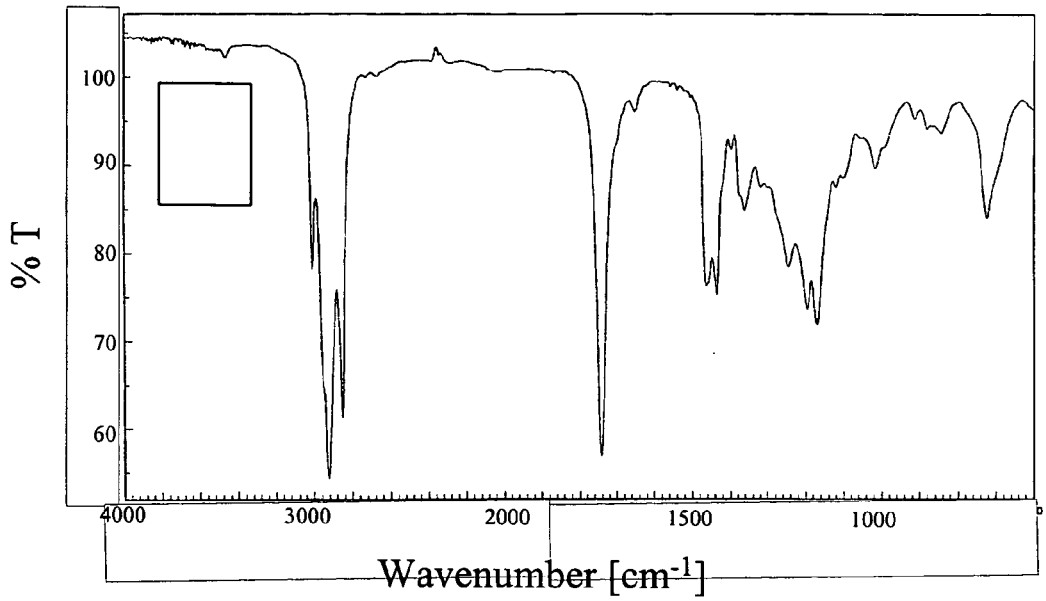
(B)
Ozone-treated Sunflower oil methyl ester
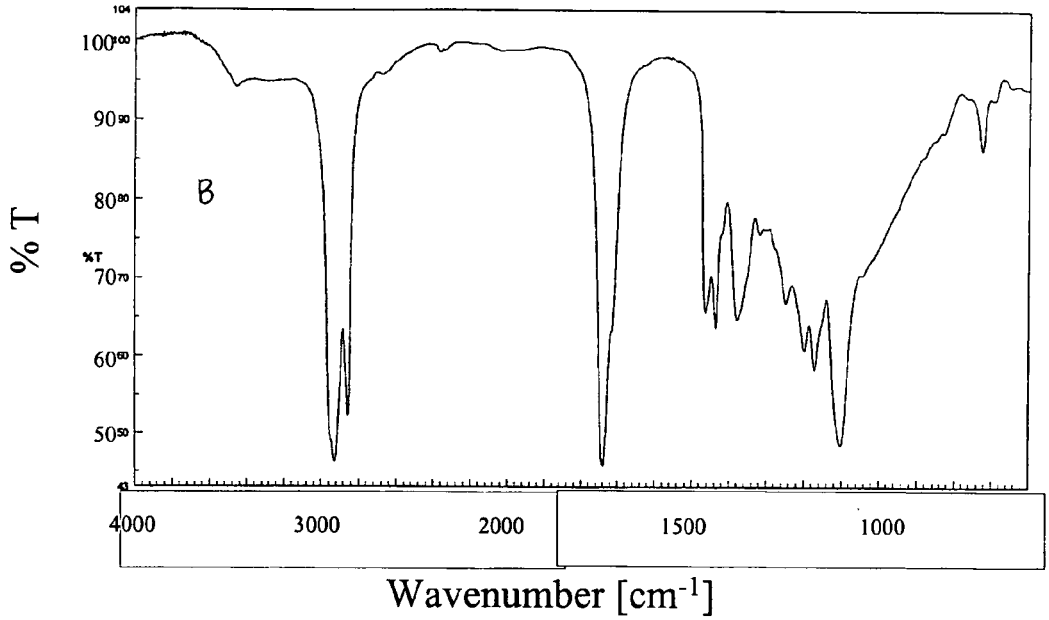

【Fig. 3】
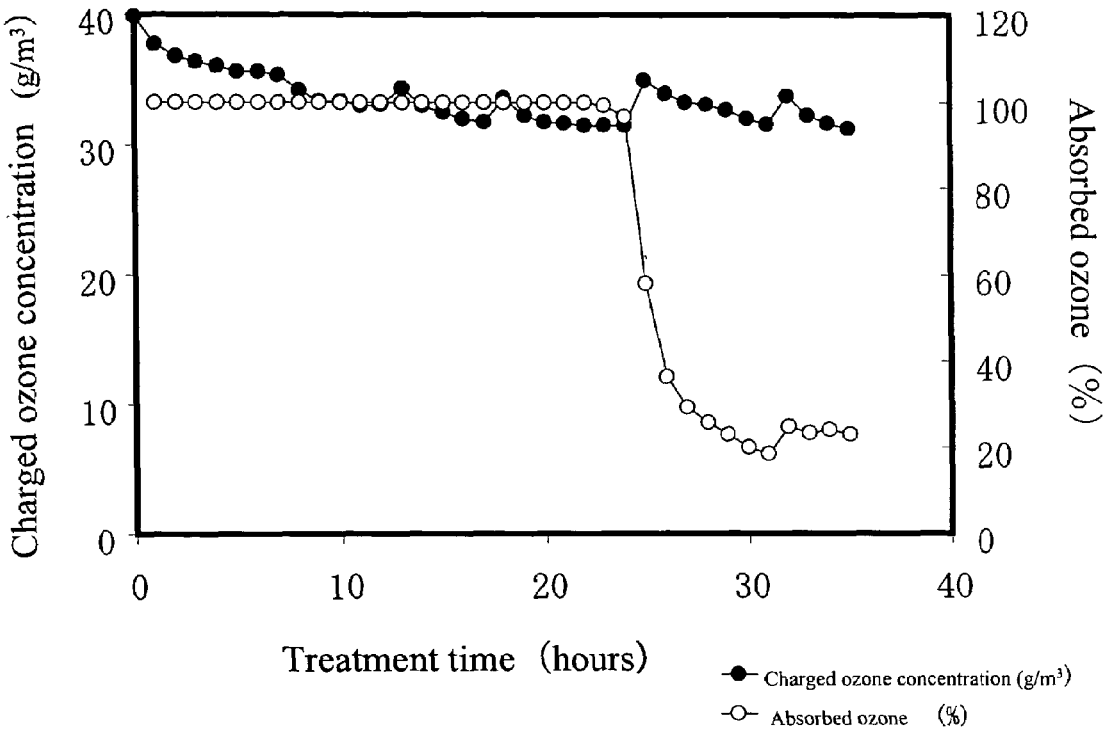
Change in ozone absorption with time be sunflower oil methyl ester

【Fig. 4】
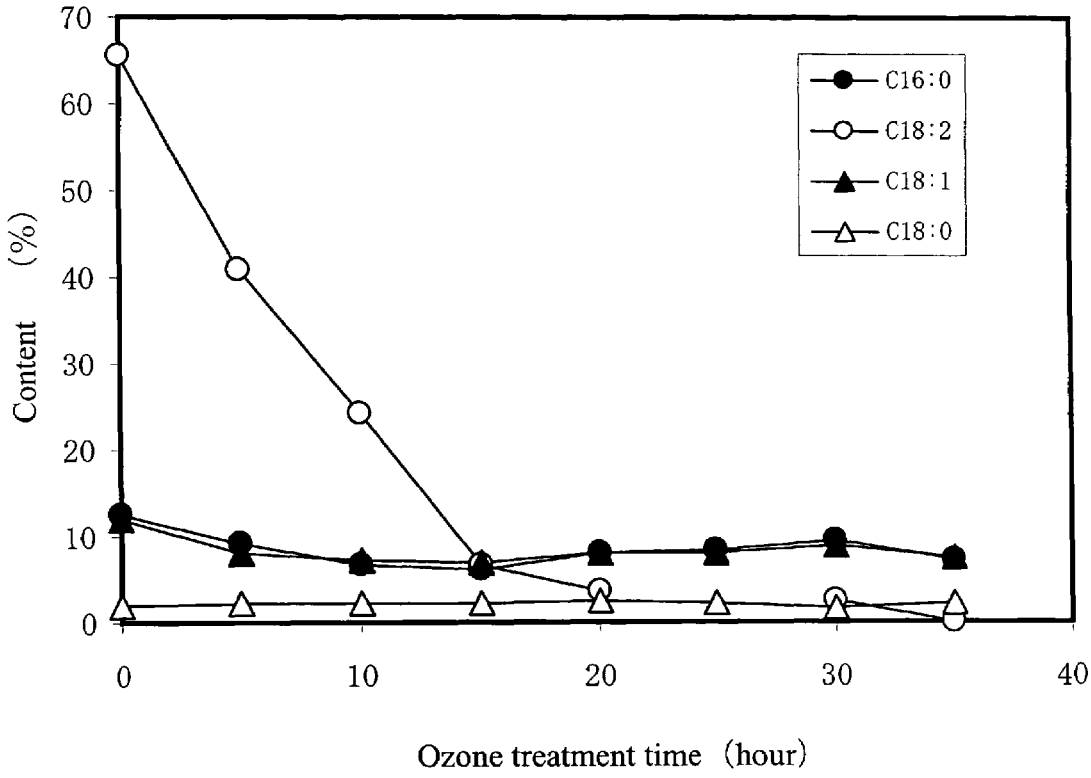
Change in composition of fatty acid methyl ester by ozone treatment

【Fig. 5】
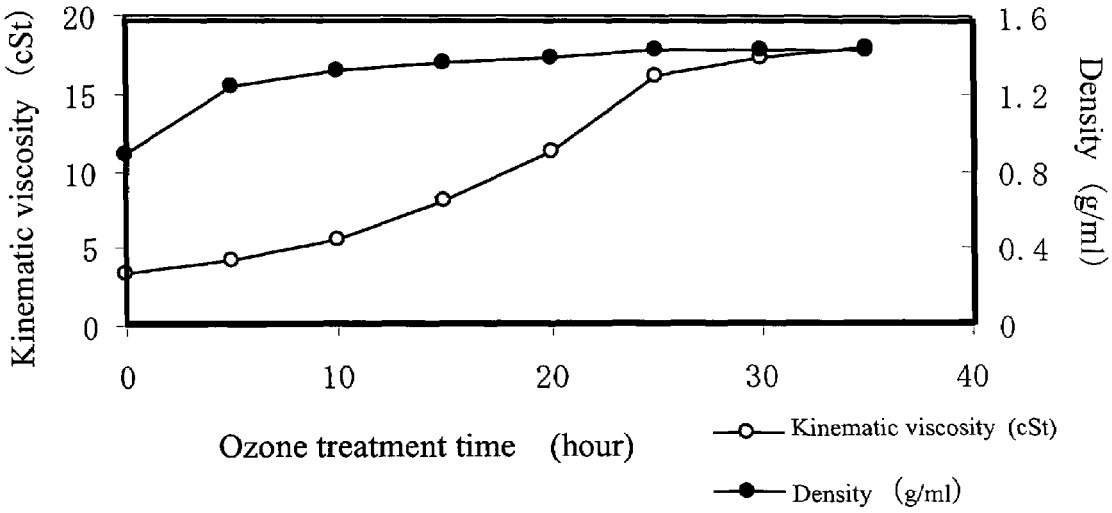
Changes in density and kinematic viscosity by ozone treatment of sunflower oil methyl ester

【Fig. 6】
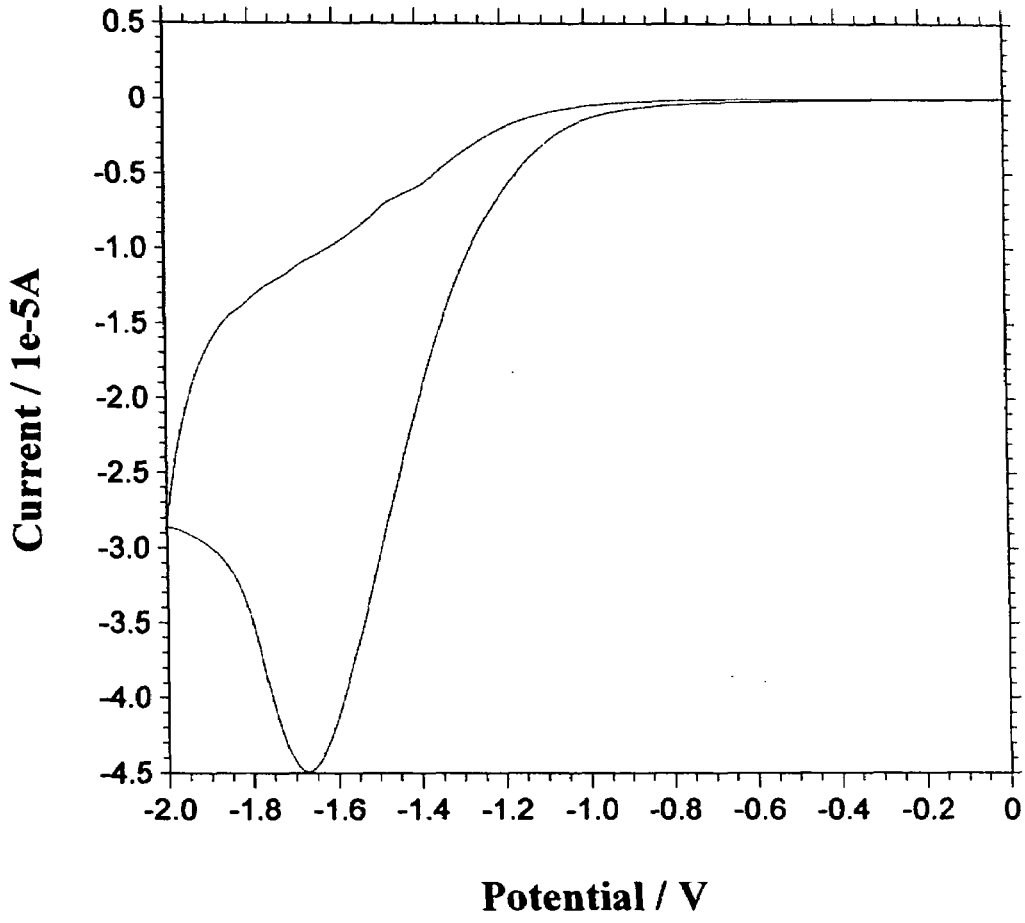
Cyclic voltameter of ozonide

【Fig. 7】
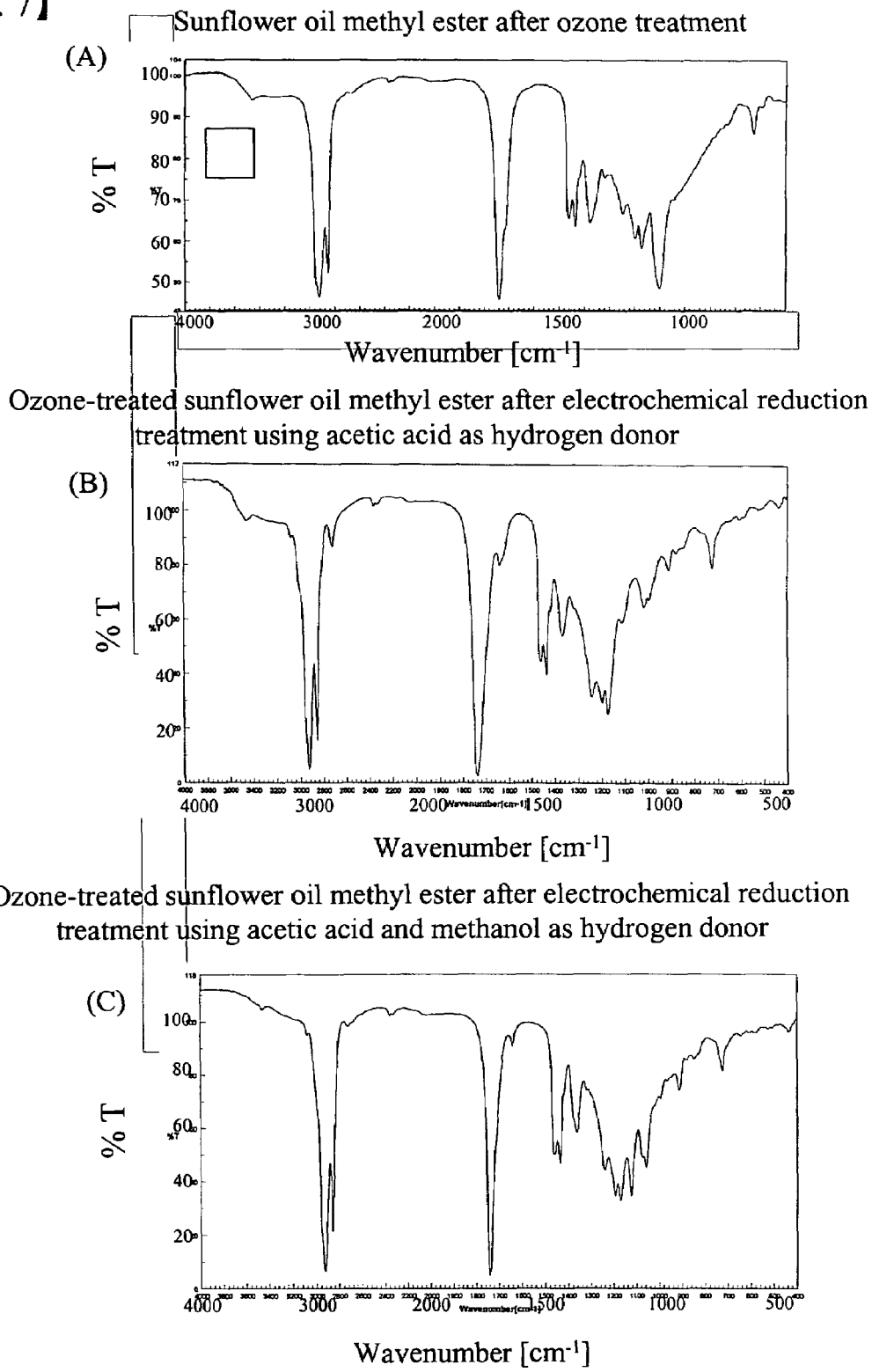

【Fig. 8】
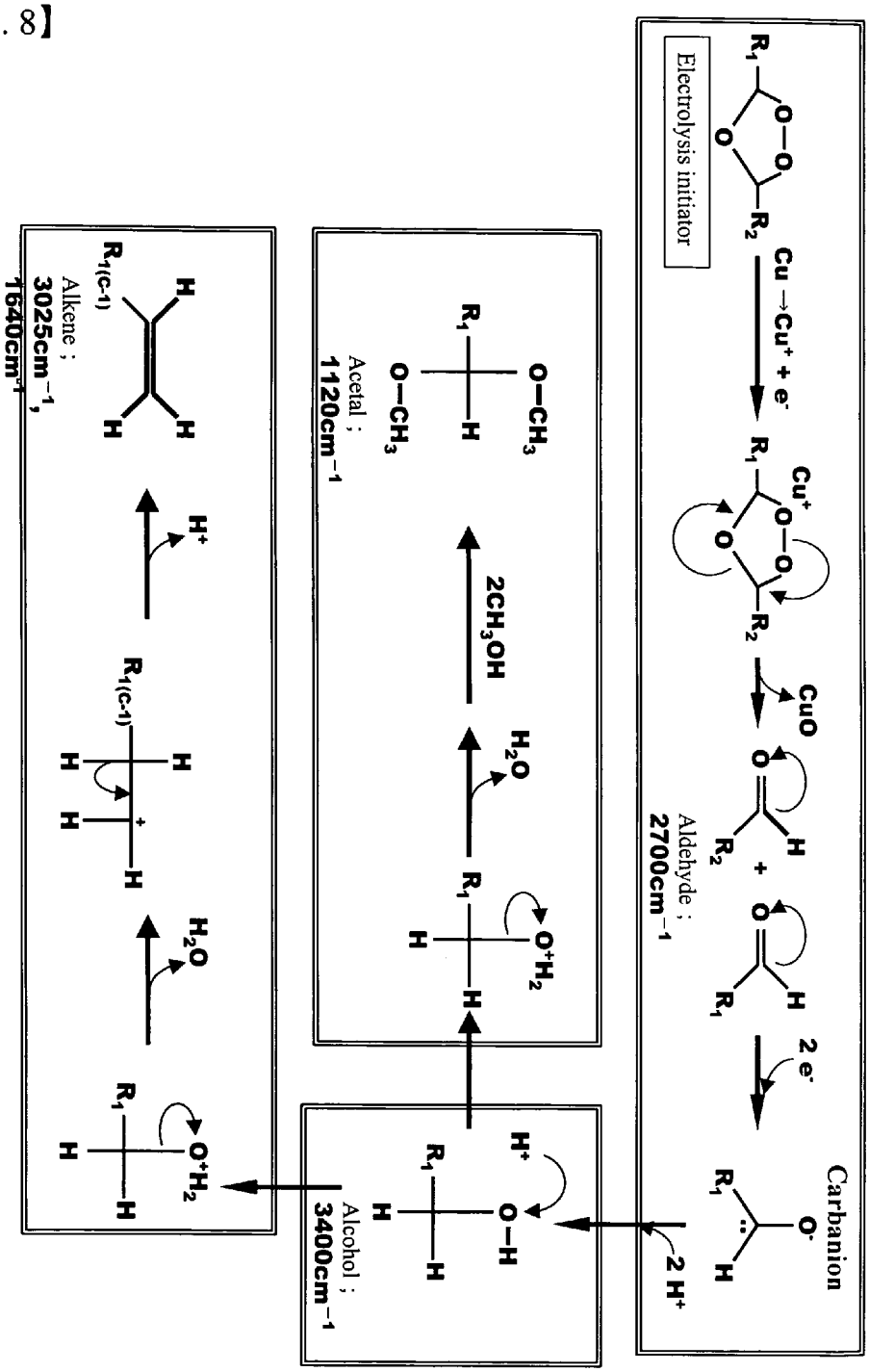
Operating condition voltage : 25 V Current : 1 A Electrode : Anode/Cathode Copper
Reaction mechanism in electrochemical reduction treatment of ozone-treated sunflower oil methyl ester 【Fig. 9】
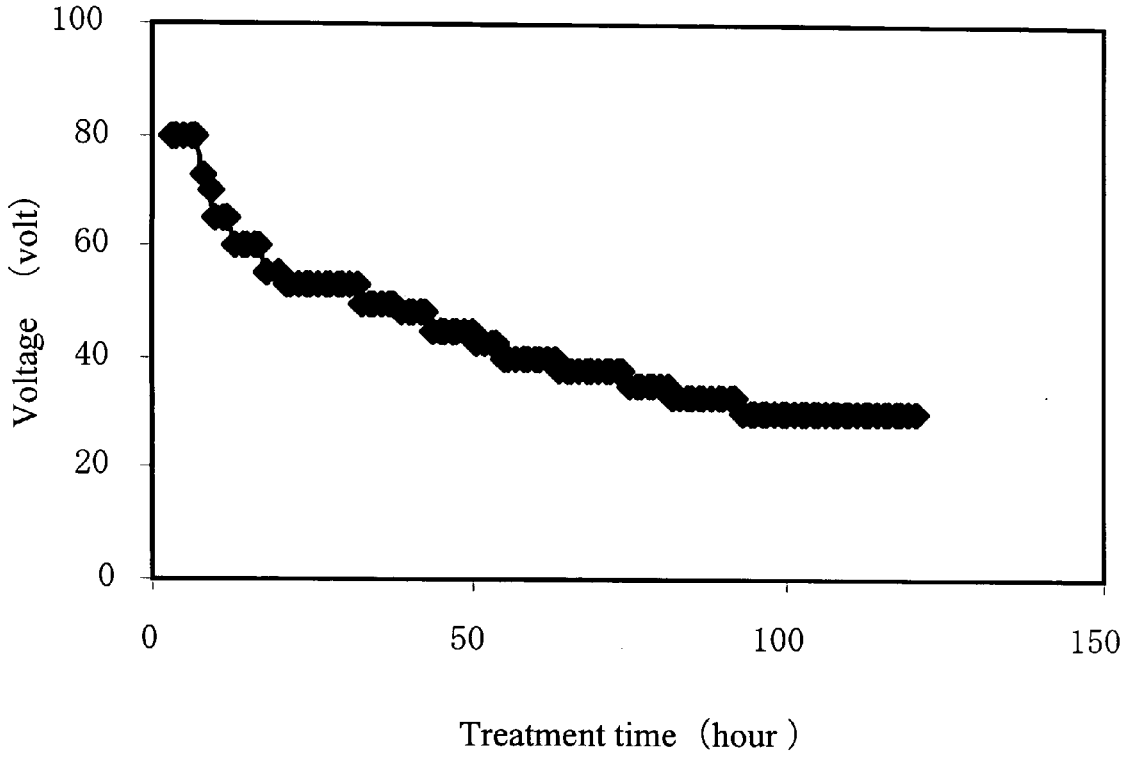
Change in voltage in constant-current electrochemical treatment of ozonide

<R1~R3 : Hydrocarbon Group including Double Bond>

METHOD FOR PRODUCING VEGETABLE OIL FUEL

BACKGROUND OF THE INVENTION

1. Technical Field

The present invention relates to a method for producing vegetable oil fuel, and specifically to a method for producing vegetable oil fuel useful as low-pollution alternative fuel for diesel engine.

2. Background Art

Though a diesel engine has advantages over a gasoline engine in fuel efficiency and endurance, air pollutants such as $CO_2$, $NO_X$, $SO_X$ and DEP (diesel engine particles) are largely included in exhaust gas emitted from this diesel engine, so that development of low-pollution fuel as an alternative to light oil has been advanced.

On the other hand, new diesel engines of low-pollution type or DEP eliminators have also been developed. However, since about 500 ppm of sulfur is included in conventional light oil, there is a problem that a function of the new engines or the DEP eliminators is decreased, and development of low-pollution fuel in which sulfur is lowered to 50 ppm or less is desired.

Eventually, there is a limit to technical approaches of improvement in the engine itself or improvement in its peripheral device in order to promote a decrease in pollution of the diesel engine, so that it is considered that approaches from an aspect of fuel are promising.

Recently, studies on alternative light oil using vegetable oil have been advanced among development of low-pollution fuel in which sulfur is not included. Among the studies, "methyl esterified fuel" obtained by mixing methanol (or ethanol) and a catalyst (sodium hydroxide) into vegetable oil (vegetable waste oil) and heating and stirring them and advancing a transesterification reaction, etc. has received attention.

The inventors of the present application revealed that a reaction product such as ozonide obtained by directly performing ozone treatment of vegetable oil and fat had combustibility and showed preferred properties acting as the alternative light oil than the conventional methyl esterified fuel and further the reaction product could improve concentrations of $CO_2$, $SO_X$ and $NO_X$ included in exhaust gas of the diesel engine to 50 to 30% or less of a conventional level as compared with conventional light oil commercially available as disclosed in U.S. Pat. No. 6,364,917 B1.

However, the existing methyl esterified fuel has problems that viscosity, the pour point and the flash point are high as compared with commercially available light oil and also the yield is low in a production step, so that it is difficult to adopt the methyl esterified fuel as alternative light oil fuel at the present point in time. This is probably mainly attributable to the direct use of long-chain fatty acid ester (fatty acid ester with high molecular weight) obtained by methyl esterification of vegetable oil. Because of this, generally, the methyl esterified fuel is used in blend with light oil or kerosene in Europe and America.

Also, in the conventional art disclosed in the patent of U.S. Pat. No. 6,363,917 B1, there was a technical problem that viscosity of the reaction product is still at a high level as compared with commercially available light oil.

SUMMARY OF THE INVENTION

The present invention provides a method capable of producing vegetable oil fuel ("vegetable oil fuel" means fuel produced by using vegetable oil as raw material) with low viscosity by electrochemical cracking of vegetable oil.

First, a method for producing vegetable oil fuel according to the present invention includes at least a transesterification step with respect to vegetable oil using vegetable oil with triglyceride (triglycerol) structure having unsaturated fatty acids as raw material, an ozone treatment step with respect to unsaturated fatty acid ester generated in the transesterification step, and a reduction step with respect to ozonide generated in the ozone treatment step. Each of the steps will be described in detail below.

In the transesterification step, alcohol such as methanol is reacted on the triglyceride in the vegetable oil to exchange an alkoxy group, so-called, "alcoholysis" (a kind of transesterification) is performed and a reaction product including unsaturated fatty acid methyl ester and glycerin (glycerol) is obtained. That is, by this step, a triglyceride structure is destroyed and the unsaturated fatty acid methyl ester is liberated. Other alcohol such as ethanol or propanol can also be used to liberate fatty acid ethyl or propyl esters, respectively.

In the transesterification step, a commonly used procedure performed in the presence of excessive methanol using sodium hydroxide (NaOH) as a catalyst may not be adopted, and it is contrived so as to select and use sodium methoxide ($NaOCH_3$) as a catalyst. Since there is no phenomenon in which $NaOCH_3$ reacts with methanol to generate water, there is an advantage that generation of a by-product can be minimized in the "ozone treatment step" described below.

Next, it is contrived so that recovery of excessive methanol is made efficiently and the recovered methanol is reused in the transesterification step while the glycerin is separated and removed from among the reaction products including the unsaturated fatty acid methyl ester and the glycerin using a vacuum continuous centrifugal separator.

In the subsequent "ozone treatment step", ozone $O_3$ is brought into contact with the unsaturated fatty acid methyl ester and the ozone is added to the carbon-carbon (C=C) double bond portion of the unsaturated fatty acid methyl ester and combustible ozonide is generated.

In the subsequent "reduction step", reduction treatment of the ozonide is performed to obtain acetal or alkene which is a combustible substance cracked finally. That is, a series of reactions of the ozone treatment step and the subsequent reduction step is the so-called ozonolysis reaction and can be called cracking treatment step using this ozonolysis reaction.

A particularly advantageous reduction step in the present invention may be "an electrochemical reduction step" by electrolysis. The ozonide is generally a substance with relatively high reactivity and it is known that cleavage occurs by chemical reduction under the influence of a metal catalyst. However, there was conventionally no idea of applying "electrolysis" to the reduction of the ozonide with extremely low electrical conductivity. When success in electrochemical reduction of the ozonide is achieved, there is an advantage that cracking premised on normal thermolysis treatment can be implemented under room temperature and atmospheric pressure.

Therefore, the inventors of the present application made studies with effort and first revealed a reduction potential of the ozonide by a cyclic voltammetric method. Then, they found out that cleavage of the ozonide advanced efficiently based on conductivity of carbanion generated from the ozonide when electrolysis was performed using an active electrode for eluting metal.

Particularly in the case of using copper in an anode and a cathode, addition of an oil and fat soluble electrolyte such as $LiClO_4$ or $NaClO_4$ as electrolyte enables electrochemical reduction of the ozonide to be surely achieved by a voltage of about 50 V. Also, there is an advantage that the amount of addition of the oil and fat soluble electrolyte is sufficient by a small amount necessary for an electrolysis start since an ionic reactive intermediate product is generated as the electrochemical reduction step advances.

Electrodes that can be used in the electrochemical reduction step include aluminum, magnesium, zinc, platinum, palladium and copper. The products generated in this step include acetal, alkene, aldehyde and alcohol whose relative amounts depend on the type of electrode used. The use of copper as electrode is preferred because of its low price and good availability. Addition of an oil and fat soluble electrolyte such as $LiClO_4$ or $NaClO_4$ (3-5% (w/v) with respect to ozonide) as supporting electrolyte and acetic acid and/or methanol as proton donors (1:1 to 1:5 proton donor to ozonide volume ratio) enable the electrochemical reduction of the ozonide with a voltage and current ranging from 25 to 100 V and 0.5 to 2 A, respectively. Also, there is an advantage that the amount of addition of the oil and fat soluble electrolyte is sufficient by a small amount necessary for an electrolysis start since an ionic reactive intermediate product (carbanion) is generated as the electrochemical reduction step advances.

Also, there is an advantage that the desired reduction products can be achieved by adding different types and amounts of proton donors such as acetic acid and methanol, or a mixture of them in varying proportions. Then, a metal ion (for example, a copper ion) eluted in a reaction solution in a process of electrolysis can be removed efficiently from among the reaction solution by adsorbing the metal ion on activated carbon or a chelating agent and thereby, the metal ion can be prevented from mixing into fuel which is a final product. Incidentally, there is an advantage that adsorption and removal of the metal ion by the activated carbon eliminates the need for wastewater treatment equipment as in the case of water washing removal.

Further, in a process of the ozone treatment step with respect to the unsaturated fatty acid methyl ester, by-products other than the ozonide are generated, but these by-products can also be decomposed by the electrochemical reduction step to lead to a combustible substance cracked.

A combustible reaction product obtained through the "reduction step" described above is cracked in molecular weight, so that the reaction product has an advantage that viscosity is low. Specifically, vegetable oil fuel with viscosity comparable to or lower than viscosity (about 2.5 cSt at 40° C.) of commercially available diesel oil can be obtained. As a result of this, this vegetable oil fuel can be used without mixing the vegetable oil fuel with light oil or kerosene.

Here, vegetable oil available in the present invention is vegetable oil triglyceride (triacylglycerol) structure having at least one unsaturated fatty acid, and can include, for example, sunflower oil, rapeseed oil, linseed oil, safflower oil, soybean oil, peanut oil, sesame oil, colza oil, corn oil, seakale oil, cottonseed cicely oil and so on.

The sunflower oil is particularly preferable. The sunflower oil has 17% of oleic acid (18:1) and 74% of linoleic acid (18:2) and unsaturated fatty acid accounts for a total of 91%, so that the ozone treatment step of a double bond portion can be performed efficiently. Particularly, linoleic acid having two double bonds has high reactivity with ozone, so that the sunflower oil richly including the linoleic acid is suitable for raw material of a producing method according to the present invention.

Also, in using sunflower oil, pulp production can be performed from the stalk portions and growth is swift and harvest can be obtained after about four months have elapsed since seeding. For example, in a breed called sunlight, as large as 2.6 tons of fruit bodies per hectare (ha) can be harvested. An oil content in this fruit body is 52% and 1.35 tons of oil per ha can be obtained after all (Growth area: data based on trial growth in Hokkaido). Also, since growth of a sunflower is swift, the sunflower is excellent in its ability to absorb and fix carbon dioxide in the atmosphere, so that production activity of the sunflower aimed at production of raw material of light oil alternative fuel also contributes to an improvement in the global environment.

In summary, there is technical advantage capable of efficiently producing vegetable oil fuel with low viscosity suitable for diesel oil alternative fuel by the combinations of a transesterification step with respect to vegetable oil such as sunflower oil with triglyceride (triacylglycerol) structure having at least one unsaturated fatty acid, an ozone treatment step with respect to unsaturated fatty acid methyl ester generated (liberated) in this transesterification step, and a reduction step such as an electrochemical reduction step with respect to ozonide generated in this ozone treatment step.

BRIEF DESCRIPTION OF THE DRAWINGS

FIG. 1 is a step flow diagram of a method for producing vegetable oil fuel according to the present invention.

FIG. 2 is a diagram (graph) showing an infrared light absorption analysis result:

(A) sunflower oil methyl ester; and (B) ozone-treated sunflower oil methyl ester.

FIG. 3 is a diagram (graph) showing a change in ozone absorption with time by sunflower oil methyl ester.

FIG. 4 is a diagram (graph) showing a change in composition of fatty acid methyl ester by ozone treatment.

FIG. 5 is a diagram (graph) showing changes in density and kinematic viscosity by ozone treatment of sunflower oil methyl ester.

FIG. 6 is a diagram (graph) showing a cyclic voltamogram of ozonide.

FIG. 7 is a diagram (graph) showing an infrared light absorption analysis result of:

(A) sunflower oil methyl ester after ozone treatment;

(B) ozone-treated sunflower oil methyl ester after electrochemical reduction treatment using acetic acid as a proton donor; and (C) ozone-treated sunflower oil methyl ester after electrochemical reduction treatment using acetic acid and methanol as a proton donor.

FIG. 8 is a diagram showing a reaction mechanism in electrochemical reduction treatment of ozone-treated sunflower oil methyl ester:

(A) a reaction stage in which by reduction of ozonide, the ozonide is cleaved and carbanion is generated;

(B) a reaction process in which a proton ($H^+$) is supplied from an electron donor to the carbanion and combustible alkene which is a final product is generated through alcohol; and (C) a reaction process in which a proton ($H^+$) is supplied from a proton donor to the carbanion and combustible acetal which is a final product is generated through alcohol.

FIG. 9 is a diagram (graph) showing a change in voltage in constant-current electrochemical reduction treatment of ozonide.

Figure 10:
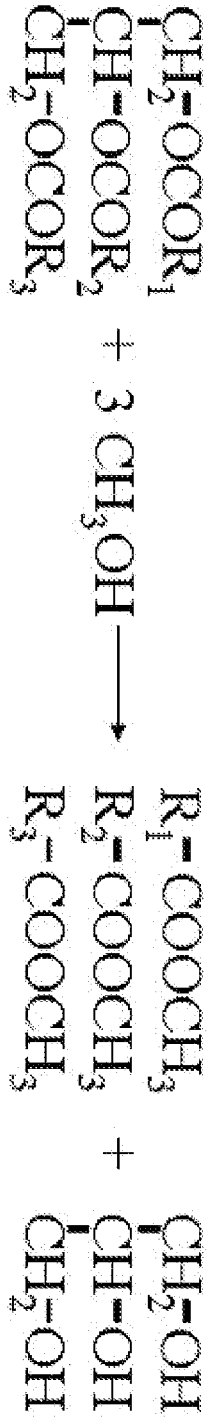

FIG. 10 shows a transesterification reaction of vegetable oil with methyl alcohol.

Figure 11:
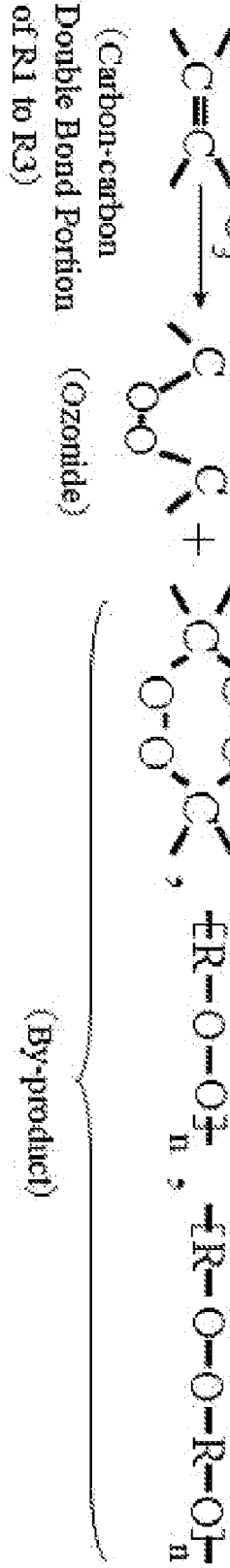

FIG. 11 shows an ozone treatment step of vegetable esterified oil.

DETAILED DESCRIPTION OF THE PREFERRED EMBODIMENT

A preferred embodiment of a method for producing vegetable oil fuel according to the present invention will be described below based on the accompanying drawings. However, it is to be understood that any of the features disclosed in the following can be used as such and individually for further embodiments although said features are disclosed in the context of a combination of other features in the following.

First, FIG. 1 is a step flow diagram of a method for producing vegetable oil fuel according to the present invention.

First, a method for producing vegetable oil fuel according to the present invention is characterized by comprising at least a transesterification step $P_1$ of performing a transesterification reaction with respect to vegetable oil with triglyceride (triacylglycerol) structure having unsaturated fatty acid, an ozone treatment step $P_2$ of bringing ozone into contact with unsaturated fatty acid methyl ester generated in this transesterification step $P_1$, and a reduction step $P_3$ of reducing and cleaving ozonide generated in this ozone treatment step $P_2$. A preferred embodiment of each of the steps $P_1$ to $P_3$ will be sequentially described below.

Transesterification Step $P_1$

First, a transesterification step $P_1$ is a transesterification reaction with respect to vegetable oil such as sunflower oil, linseed oil, safflower oil, rapeseed oil, soybean oil, peanut oil, sesame oil, colza oil, corn oil, seakale oil or cottonseed cicely oil with triglyceride structure having unsaturated fatty acid such as oleic acid or linoleic acid. Particularly preferably, the reaction is a reaction in which an alkoxy group exchange is performed (alcoholysis is performed) by adding excessive methyl alcohol to sunflower oil including 90% or more of unsaturated fatty acid and richly including linoleic acid particularly and unsaturated fatty acid methyl ester and glyceride are liberated from the triglyceride (see FIG. 10).

Sodium methoxide ($NaOCH_3$) is more preferable as a catalyst than NaOH and KOH in the case of the transesterification reaction in the production method according to the present invention. This is because generation of a by-product can be minimized in the ozone treatment step $P_2$ described below since there is no phenomenon in which basic catalyst like NaOH reacts with methanol to generate water.

In a preferable condition of the present transesterification reaction, a molar ratio of sunflower oil to methanol is set at a ratio of 1 to 6 (where molar molecular weight of sunflower oil is 879.5 g/mol) and sunflower oil and methanol are mixed and $NaOCH_3$ previously dissolved in methanol is added to this mixture so as to become a weight ratio of 0.5% with respect to sunflower oil. In a stirring reaction tank equipped with a cooling reflux device, a temperature is held at 60 to 70°C. and a reaction is performed for 30 to 60 minutes. By this condition, 98% or more of transesterification is achieved.

Subsequently, an excessive amount of methanol is recovered while vacuum centrifugal separation treatment is performed with respect to a reaction product by the transesterification step $P_1$ to separate unsaturated fatty acid methyl ester and glycerine (glycerol). The recovered methanol is reused in the transesterification step $P_1$.

Ozone Treatment Step $P_2$

Ozone ($O_3$) is brought into contact with esterified sunflower oil obtained in the transesterification step $P_1$. In a preferable condition of ozone treatment, the esterified sunflower oil is held at a reaction temperature of 20 to 30° C. inside a stirring reaction tank with gas sparging system and at the sparging rate of ozone mixed gas set at 2 to 4 vvm and the amount of ozone charged (the amount of ozone added per unit volume of the esterified sunflower oil) is set at 1000 to 2000 kg-$O_3$/$m^3$. By this ozone treatment, ozonide in which the ozone is added to the carbon-carbon (C═C) double bond portion of unsaturated fatty acid methyl ester and its by-product are generated (see FIG. 11).

FIG. 2 shows the formation of ozonide and the disappearance of unsaturation after ozone treatment of esterified sunflower oil for three hours under the above preferable condition by means of Fourier transform infrared spectroscopic analysis (FT-IR).

FIG. 2(A) shows the spectroscopic analysis by FT-IR of the esterified sunflower oil. Characteristic molecular structure of esterified sunflower oil such as C═C and ═C—H were observed at 1650 and 3200 $cm^{-1}$, respectively.

FIG. 2(B) shows the spectroscopic analysis by FT-IR after ozone treatment was performed for three hours, and the light absorption peaks of C═C and ═C—H disappeared entirely and the new peak appeared at an ozonide infrared light absorption wavelength of 1105 $cm^{-1}$.

Also, FIG. 3 shows the result of measuring an ozone concentration in a gas inlet and outlet of a ventilation stirring reaction tank in ozone treatment and calculating the change in ozone absorption with time. As is evident from the present drawing, a reaction of ozone with a carbon-carbon double bond is very fast and as long as the carbon-carbon double bond exists, the charged ozone is fully absorbed. Thus, it is found that there is no need for waste gas treatment of the ozone emitted from the reaction tank. Also, measurement of the ozone concentration in the reaction tank outlet provides a very convenient way of determining the progress of the reaction.

FIG. 4 shows the result of measuring the change in the amount of various unsaturated fatty acid methyl ester in esterified sunflower oil in experiment of FIG. 3 by means of GC/MS (gas chromatography mass spectrometry). It is apparent that linoleic acid methyl ester (C18:2) having two carbon-carbon double bonds reacts with ozone preferentially over oleic acid methyl ester (C18:1) having one carbon-carbon double bond, and vegetable oil having fatty acid with a large number of carbon-carbon double bonds is suitable.

Here, a by-product also shown in the above chemical formula (2) generated along with ozonide has thickening action. FIG. 5 shows changes in viscosity and density of esterified sunflower oil in an ozone treatment process shown in FIG. 3. Viscosity (4 cSt at 40° C.) of the esterified sunflower oil before ozone treatment increases to the vicinity of 17 cSt (at 40° C.) with increasing ozone treatment time. As a result of this, a reaction tank with a jet pump or a stirring device having strong shear force is desirably used in the ozone treatment in the present production method.

The result of this experiment also proved that the increase in the amount of by-product resulted to increase in viscosity when an excessive amount of ozone was added. As a result of this, it is desirable to run the method such as to generate ozonide while adding the minimum required amount quantitatively in the amount of ozone addition and suppressing generation of the by-product.

Reduction Step $P_3$

The reduction step $P_3$ is a step of performing reduction treatment with respect to the ozonide and the by-product obtained in the ozone treatment step $P_2$, and is a step of obtaining low-molecular weight compounds (for example, acetal or alkene) having good combustibility. In the present production method, electrochemical reduction treatment based on electrolysis rather than commonly used chemical reduction is adopted.

FIG. 6 is an analysis result obtained by using a cyclic voltameter performed in order to verify that the ozonide can be cleaved by electrical reduction treatment. Glassy carbon was used as a working electrode and platinum was used as a counter electrode with respect to an $Ag/AgNO_3$ reference electrode. This FIG. 6 shows that the reduction potential of the ozonide is −1.7 V and the electrochemical reduction treatment can be performed.

In the electrolysis, copper, palladium, platinum, titanium, etc., particularly preferably copper are adopted as an anode and a cathode. Then, in order to efficiently perform the electrochemical reduction treatment with respect to ozonide with low electrical conductivity, the ozonide can be electrolyzed on a voltage condition of about 25 to 100 V by adding an oil and fat soluble electrolyte such as $LiClO_4$ or $NaClO_4$ (3-5% (w/v) with respect to ozonide) and further adding proton donor (1:1 to 1:5 proton donor to ozonide volume ratio). Acetic acid or methanol or mixture of them in varying proportions can be used as proton donor. The desired mixture of products in this step can be attained by varying the type and amount of proton donor used (e.g. higher amount of methanol relative to acetic acid leads to product rich in acetal than alkene).

FIG. 7(A) shows the FT-IR spectrum obtained after performing ozone treatment of methyl esterified sunflower oil, and it is found that unsaturated bonds C═C and ═C—H at light absorption wavelengths of 1650 $cm^{-1}$ and 3200 $cm^{-1}$ disappear and ozonide at 1105 $cm^{-1}$ exists.

FIG. 7(B) shows the FT-IR analysis result of ozonide of esterified sunflower oil after conducting electroreduction. Particularly in this case, acetic acid was used as a proton donor and copper was used as anode and cathode. $LiClO_4$ was added as an electrolyte and treatment was performed at 25 V and 1 A for about 1.5 hours in the case of electrical reduction of ozone-treated esterified sunflower oil. The peak at 1105 $cm^{-1}$ of ozonide disappeared substantially and aldehyde (2700 $cm^{-1}$) and alkene (1640 $cm^{-1}$) were detected newly.

Also, an FT-IR analysis result of the case of adding methanol together with acetic acid and performing similar electrical reduction is shown in FIG. 7(C). In this case, the peaks of aldehyde and alkene decrease and acetal having a light absorption wavelength at 1120 $cm^{-1}$ appears.

Here, FIG. 8 is a diagram simply showing a proposed reaction mechanism of electrochemical reduction (electrolysis by copper electrodes) of ozonide assumed based on the above experimental results. First, FIG. 8(A) shows a reaction stage in which by reduction of ozonide, the ozonide is cleaved and carbanion is generated.

It is apparent from an experiment on a change in voltage in constant-current electrochemical treatment of ozonide shown in FIG. 9 that this carbanion is an electrically conductive intermediate reactant. $NaClO_4$ was added as an electrolyte and constant-current electrical reduction at 0.5 A was performed and a change in voltage was measured. The carbanion accumulated with progress of the electrical reduction and the voltage decreased from 80 V at the time of an experiment start to 30 V.

FIG. 9 shows the current vs time curve during the electroreduction of ozonide. The electrolysis was conducted by passing 50 V of electricity in 50 ml of ozonide containing 5g of $LiClO_4$ and 10 ml each of methanol and acetic acid. Using the Faraday's Law, it was found out that only electron is involved in the reduction of ozonide. Also the maxima of the plot indicate the formation of a charged intermediate, probably a carbanion responsible for the increase in current. As this intermediate is transformed to neutral species, the current gradually drops.

FIG. 8(B) shows a reaction process in which a proton ($H^+$) is supplied from an electron donor to the carbanion and combustible alkene which is a final product is generated through alcohol.

FIG. 8(C) shows a reaction process in which a proton ($H^+$) is supplied from an electron donor to the carbanion and combustible acetal which is a final product is generated through alcohol.

Incidentally, in the case of the above-mentioned reduction step $P_3$, electrolysis of the by-product in addition to the ozonide proceeds, so that viscosity could be decreased from 17 cSt (at 40°C.) of ozone-treated esterified sunflower oil to 2.75 cSt (at 40° C.) comparable to commercially available diesel oil.

According to the electrochemical reduction step based on this electrolysis, the so-called cracking can be performed on conditions of room temperature and atmospheric pressure, so that there are extremely advantages in production cost or energy consumption.

Here, methyl alcohol ($CH_3OH$), primary alcohol such as ethanol ($CH_3CH_2OH$), secondary alcohol such as s-butyl alcohol, tertiary alcohol such as t-butyl alcohol, and acetic acid ($CH_3COOH$), etc. or a mixture of any of them can be adopted as the proton donor, and composition or properties of a low-molecular combustible substance which is a final product can be changed by selecting a kind of this proton donor. For instance, the amount of acetal relative to alkene in the final product can be increased by using higher amount of alcohol than acetic acid in case a mixture of them is to be used.

Incidentally, a metal ion (for example, cuprous ion (Cu+)) eluted in a reaction solution in a process of electrolysis can be removed efficiently from the reaction solution by adsorbing the metal ion on an adsorbent such as activated carbon or a chelating agent. As a result of this, the metal ion can be prevented from mixing into fuel which is the final product. Incidentally, there is an advantage that adsorption and removal of the metal ion by the activated carbon or the chelating agent, etc. eliminates the need for waste water treatment equipment as in the case of water washing removal of the metal ion.

In accordance with a method for producing vegetable oil fuel according to the present invention, after transesterification of vegetable oil, ozone treatment is performed to obtain ozonide and reduction treatment of this ozonide is performed and thereby, low-molecular fuel having low viscosity and high combustibility can be obtained.

The invention claimed is:

1. A method for producing vegetable oil fuel, comprising the following steps: providing a vegetable oil with triglyceride structure having at least one unsaturated fatty acid, performing a transesterification step with respect to the vegetable oil, performing an ozone treatment step with respect to unsaturated fatty acid methyl ester generated in the transesterification step, and performing an electrochemical reduction step with respect to ozonide generated in the ozone treatment step, wherein the reduction step completes cracking of the unsaturated fatty acid methyl esters to form vegetable oil fuel having a low viscosity.

2. A method for producing vegetable oil fuel as claimed in claim 1, wherein a copper electrode is used in the electrochemical reduction step.

3. A method for producing vegetable oil fuel as claimed in claim 1, wherein a copper ion eluted from the copper electrode in the case of the electrochemical reduction step is removed from a reaction product by adsorbing the copper ion on activated carbon or a chelating agent.

4. A method for producing vegetable oil fuel as claimed in claim 1, wherein the vegetable oil is sunflower oil.

* * * * *